US008156664B2

(12) United States Patent
Shepherd et al.

(10) Patent No.: US 8,156,664 B2
(45) **Date of Patent: *Apr. 17, 2012**

(54) PADDED SHOE

(75) Inventors: Steven H. Shepherd, West Palm Beach, FL (US); Timothy P. McCabe, Lake Worth, FL (US)

(73) Assignee: Ringstar, Inc., Lake Worth, FL (US)

( * ) Notice: Subject to any disclaimer, the term of this patent is extended or adjusted under 35 U.S.C. 154(b) by 908 days.

This patent is subject to a terminal disclaimer.

(21) Appl. No.: 12/125,530

(22) Filed: May 22, 2008

(65) Prior Publication Data

US 2008/0263897 A1 Oct. 30, 2008

Related U.S. Application Data

(63) Continuation-in-part of application No. 11/558,529, filed on Nov. 10, 2006, now Pat. No. 7,774,957.

(51) Int. Cl.
*A43B 23/26* (2006.01)
*A43B 13/14* (2006.01)
*A43B 5/00* (2006.01)

(52) U.S. Cl. ..... 36/54; 36/89; 36/99; 36/71; 36/72 R; 36/114

(58) Field of Classification Search ..... 36/54, 89, 36/99, 71, 72 R, 114, 133, 93, 55, 50.1
See application file for complete search history.

(56) References Cited

U.S. PATENT DOCUMENTS

| | | | | |
|---|---|---|---|---|
| 4,103,437 | A | 8/1978 | Dillard | |
| 5,566,476 | A | 10/1996 | Bertrand et al. | |
| 5,682,685 | A | 11/1997 | Terlizzi | |
| 6,971,192 | B2 | 12/2005 | Shepherd | |
| 7,774,957 | B2 * | 8/2010 | Shepherd | 36/54 |
| 7,886,462 | B2 * | 2/2011 | Shepherd et al. | 36/54 |
| 2009/0044427 | A1 * | 2/2009 | Shepherd et al. | 36/89 |

* cited by examiner

*Primary Examiner* — Marie Patterson
(74) *Attorney, Agent, or Firm* — Akerman Senterfitt

(57) ABSTRACT

A padded shoe, such as a kicking boot, is disclosed that is lightweight and padded for use in mixed martial arts and other related activities. The padded shoe may be formed from a flexible, resilient sole having a substantially smooth surface; a shoe upper, wherein at least a portion of the shoe upper has padding; an ankle padding structure extending from the shoe upper that is adapted to cover the medial malleolus of a wearer; a padded tongue and other components. The sole may be formed from a material having a shore durometer reading between about 40 and about 60 such that the shoe is lightweight yet provides appropriate support.

20 Claims, 9 Drawing Sheets

PADDED SHOE

CROSS REFERENCE TO RELATED APPLICATIONS

This application is a continuation-in-part application of U.S. patent application Ser. No. 11/558,529, filed Nov. 10, 2006.

BACKGROUND OF THE INVENTION

1. Field of the Invention

The present invention relates to footwear, and more particularly to a padded shoe designed for use in athletic activities such as kickboxing and other martial arts.

2. Description of the Related Art

The foot can be subjected to stresses during athletic activities. Existing athletic shoes in the art are primarily constructed to provide support for the arch and ankles of the wearer while running or jumping. However, In addition to running and jumping, some sports and fitness activities require the participant to engage in kicking maneuvers, such as martial arts and soccer. The top, sides, sole, and heel of the feet can sustain severe blows during such activities. In particular, because the natural tendency is to use the inner side of a foot to engage in kicking maneuvers, the inner side of the foot and ankle is more prone to injury. Additionally, injury can result from kicks landed against another person during certain activities, either inadvertently or, in the case of the martial arts, while sparring. First, there is a possibility that the impact of knotted shoe laces or other shoe fastening structure can injure the participants during athletic activities such as sparring. Second, there is a possibility that the impact of the harder parts of the lower limbs, such as the ankle bones, can injure the participants during the activity. It is therefore desirable to provide a shoe which protects both the wearer and the sparring partner or opponent from such injuries during activities such as martial arts and kickboxing. It is particularly desirable to provide such a shoe for use by children who may be learning martial arts.

Prior art shoes adapted to prevent injury from kicking to both the wearer and an opponent are generally those designed specifically for use in the martial arts. Shepherd, U.S. Pat. No. 6,971,192, discloses a padded shoe for use in kickboxing. This shoe is constructed of padded durable materials, including a resilient sole, and is suitable for both training and everyday wear. However, this shoe has limited flexibility due to the resilient sole covering the bottom of the shoe.

It is generally known in the art that in order to provide flexibility for the foot, a thinner shoe or a shoe with a thinner or split-sole is needed. For example, ballerina or gymnastics shoes provide exceptional flexibility to the wearer by using thinner materials, less durable materials, or simply using less material to cover the foot. In the martial arts, flexible shoes are available, but tend to fail to secure to the foot properly, provide little or no support or to the foot and ankles, and have only thin fragile soles. Additionally, such shoes do not provide any type of protection to the foot from injury during martial arts training or fighting, nor can they be worn outside.

Therefore, what is needed is a shoe which is adapted for kicking activities, which can protect a wearer of the shoe, and in the case of marital arts or soccer, can also protect other participants from injury. However, there is also a need that such shoes still provide adequate foot and ankle support to the wearer and be durable enough for everyday use. There is also a need that such a shoe permit the wearer as much flexibility as possible in the movement of the foot.

SUMMARY OF THE INVENTION

According to an arrangement of the present invention, a padded shoe, such as, but not limited to, a kicking boot, comprises a flexible, resilient sole having a substantially smooth surface; a shoe upper adjoined to the sole, wherein at least a portion of the shoe upper has padding disposed therein, the shoe upper defining a vamp having a throat and a quarter having an ankle collar top line; an ankle padding structure extending from the shoe upper, the ankle padding structure being adapted such that the ankle padding structure at least partially covers the medial malleolus of a wearer and does not cover the lateral malleolus; a padded tongue attached to the shoe upper; a retaining structure to retain the shoe on the foot of a wearer; an outer protective flap attached to the shoe upper, the outer protective flap being located such that the outer protective flap covers at least a portion of the retaining structure; and an engagement structure for securing the outer protective flap to the shoe upper, the engagement structure being located at least partially under the outer protective flap such that the outer protective flap substantially covers the engagement structure, whereby the wearer can strike a target with the shoe, and the target and the wearer are protected from injury caused by direct impact with at least one of the retaining structure, the engagement structure, and the wearer's medial malleolus.

According to another arrangement of the present invention, the flexible sole of the padded shoe is configured as a split sole, wherein the split sole comprises a separate forefoot sole portion under the front portion of the shoe upper and a separate rearfoot sole portion under the heel portion of the shoe upper, increasing flexibility of the shoe.

In the various arrangements, the outer protective flap be can padded. The outer protective flap can also be attached to the shoe upper at one side of the outer protective flap.

In at least one arrangement, the outer protective flap portion and the padded tongue portion may have closed-cell foam padding disposed therein.

In another arrangement, the retaining structure may be laces or elastic material. The elastic material may be disposed between the padded tongue portion and the sole. In this arrangement, the elastic material can go around the sides of a user's foot as the user inserts their foot into the shoe. Alternatively, the retaining structure may be disposed between the padded tongue portion and the outer protective flap. In another arrangement, the elastic material may extend between the edges of the throat.

The padding in the shoe upper may be closed cell foam having a durometer of approximately 0.253. The padding may have a density of between approximately 1.5 pcf and approximately 4.5 pcf, preferably between approximately 1.5 pcf and approximately 3.5 pcf. The padding may have a compression strength of between approximately 3 psi and approximately 23 psi at approximately 25% deflection and a compression strength of between approximately 9 psi and approximately 42 psi at approximately 50% deflection. Preferably, the compression strength may be between approximately 6 psi and approximately 22 psi at approximately 25% deflection and a compression strength of between approximately 12 psi and approximately 34 psi at approximately 50% deflection. The padding may have a tensile strength of between approximately 28 psi and approximately 145 psi, preferably between approximately 30 psi and approximately 120 psi. The padding may have a thickness between approximately 0.125 inch and approximately 3.0 inch, preferably between approximately 0.125 inch and approximately 1.5 inch, and more preferably between approximately 0.25 inch and approximately 0.5 inch. In some arrangements, the padding may have a thickness of approximately 0.375 inch. In the some arrangements, the shoe may be completely or partially padded.

In the various arrangements, the sole may have a substantially smooth lower surface. However, in some arrangements, at least a portion of the sole may have a surface pattern thereon. In such arrangements, the surface pattern may comprise of a plurality of grooves. In some arrangements, the arrangement of the plurality of grooves permits the sole to flex to generally follow the natural flexing of a wearer's foot. At least a portion of the perimeter of the sole may be chamfered. The chamfering may provide a smooth arcuate edge to the sole. The sole may also be formed at least partially from EVA. The sole can have a durometer between approximately 0.20 and approximately 0.23.

In the various arrangements, the fastening structure may be a lace threaded through eyelets disposed on the shoe upper or elastic straps. The engagement structure may include hook and loop fastener material. The shoe upper may be formed using a Strobel construction.

BRIEF DESCRIPTION OF THE DRAWINGS

There are shown in the drawings arrangements which are presently discussed, it being understood, however, that the invention is not limited to the precise arrangements and instrumentalities shown, wherein.

DETAILED DESCRIPTION OF THE DRAWINGS

Figure 1:
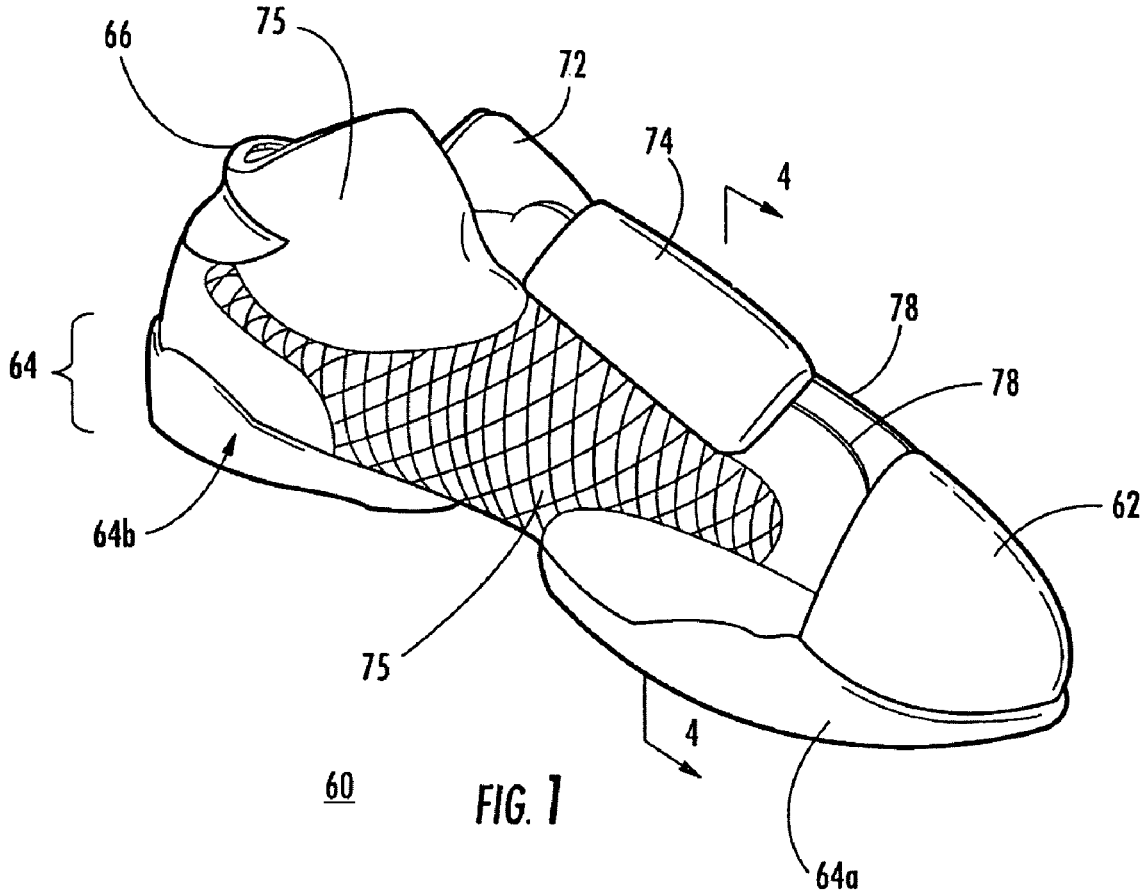
FIG. 1 is a left perspective view of a padded shoe according to an arrangement of the invention.

The present invention is directed to a padded shoe, such as, but not limited to, a kicking boot, that provides stability and protection to the ankles and foot of the wearer, yet still provides flexibility for the foot of the wearer. The padded shoe can be used for any activity which requires protection of the foot and ankles, such as athletic events. The arrangements of padded shoe described herein disclose training or sparring shoes for sports such as a boxing or kickboxing, but this is a mere example of one of many possible applications for the invention.

An arrangement of the padded shoe of the present invention is shown in FIGS. 1-4. The shoe 60 is can be formed of materials which are lightweight yet still strong and durable. The shoe 60 includes a sole 64 adjoined to a shoe upper 62. In the illustrated arrangement, the sole 64 comprises split sole including a forefoot sole 64*a* and rearfoot sole 64*b*. The shoe upper 62 can be manufactured from any conventional material such as leather, synthetic leather, or plastic. In other arrangements, a separate shin pad (not shown) may be attachable to the shoe 60. In some arrangements, an upper edge 66 of the shoe upper 62 can form a collar into which a foot can be inserted.

In the various arrangements, the shoe upper 62 can extend at least to just below the ankle of the wearer; however, the invention is not limited in that regard. For example, the shoe upper 62 can extend significantly beyond the ankle of the wearer to cover all or a portion of the shin, or not extend to the ankle of the wearer. However, in various arrangements, it is not necessary that the shoe upper 62 be symmetric about the foot, ankle or lower leg, rather the shoe upper 62 may only be extended to those areas of the foot, ankle, or lower leg needing protection. Such arrangements can result in a lighter, more flexible shoe. For example, in the illustrated arrangement in FIGS. 1-4, the shoe upper further comprises a single, generally triangular, rounded, ankle padding structure 75 extending from the collar on the inner side the shoe upper 60, designed to provide protection for the medial malleolus portion of the ankle of the wearer on the inner side of the shoe 60. In such embodiments, no corresponding ankle padding structure to protect the lateral malleous portion of the ankle of the wearer is necessary.

In the illustrated arrangement in FIGS. 1-4, a portion of the edge of the forefoot sole 64*a* and the rearfoot sole 64*b* can be chamfered to provide a continuous arcuate edge at the point where the forefoot sole 64*a* and the rearfoot sole 64*b* are joined to the shoe upper 62. The shoe 60 can have chamfered edges at the front toe and rear heel portions of the shoe 60. The forefoot sole 64*a* and the rearfoot sole 64*b* can be attached to the shoe upper 62 by any means known in the art, such as gluing, stitching, or heat sealing. Preferably, the shoe upper 62 is formed using a Strobel construction, and the forefoot sole 64*a* and the rearfoot sole 64*b* are then attached to the shoe upper 62. The Strobel construction involves stitching the shoe upper 62 to a flexible sole liner. In the Strobel construction, an insole board or other reinforcing material is absent from the shoe upper 62. The forefoot sole 64*a* and the rearfoot sole 64*b* may then be attached to the flexible lining and the shoe upper 62 by cementing, gluing, bonding or any other suitable means. This allows the sole to be flexible, which is desirable in the martial arts. Further, the shoe upper 62 can fit within a lip formed by the forefoot sole 64*a* and the rearfoot sole 64*b* so that there is a reduced chance for the upper to tear away from the sole in use. Preferably, the forefoot sole 64*a* and the rearfoot sole 64*b* are formed of low density foam made of EVA (Ethylene Vinyl Acetate) resin with a durometer between 0.20 and 0.23. The sole can thus have resiliency to the touch, and can absorb some of the force of an impact.

In the various arrangements, the shoe upper 62 can include padding material 68 disposed therein. For example, the padding material 68 can be any suitable material, for example, foam rubber, cotton, open-cell foam or closed-cell foam. The padding material 68 preferably has a high degree of resiliency and excellent shock absorption properties. In some arrangements, the padding material 68 is a closed-cell chemically cross-linked polyethylene or polyolefin foam, such as the Minicel® products manufactured by the Voltek Division of the Sekisui America Corporation. The closed-cell foams that can be used in the various arrangements and produced under the Minicel trademark include the L200, L300, L200F, L380, LS200, LS300, LS380, M200, M300, M380, MS200, MS300, MS380, T200, T300, TS200, TS300 and TS380 foams, which have excellent strength and shock absorption properties. In addition, these foams have a low degree of water absorption. Although not limited in this regard, closed-cell foam padding suitable for use in the shoe upper 62 preferably has a durometer of around 0.253. These foams also have a density of between approximately 1.5 and 4.5 pcf, a compression strength of between approximately 3 and 23 psi at approximately 25% deflection and between approximately 9 and 42 psi at approximately 50% deflection, and a tensile strength of between 28 and 145 psi.

In the various arrangements, the padding material 68 can be located throughout the shoe upper 62 or only in certain areas of the shoe upper 62. Furthermore, the padding material 68 can have an increased thickness or density on those points of the shoe upper 62 which cover portions of the foot that are more likely to be injured during athletic activities involving kicking, such as kickboxing and martial arts. Therefore, the padding material 68 may have an increased thickness or density at the portion of the shoe upper 62 that covers the forward dorsal region of the foot, the top of the foot, the posterior aspect of the heel, the left and right forward lateral aspects of the foot, and/or the ankle portion. For example, because there is a natural tendency to kick with the inner side of the foot, more padding or thicker padding may be placed on the inner side of the shoe. As previously discussed, in the arrangement shown in FIGS. 1-4, such increased protection is provided to the ankle region by extending the shoe upper 62 to provide a generally triangular ankle padding structure 75 covering at least a portion of the medial malleolus of the wearer's ankle, wherein the apex can extend approximately 1.5 inches beyond an edge of the shoe upper 62. However, the generally triangular shape of the ankle padding structure 75 is provided by way of example, not limitation, and it is contemplated by this disclosure that the ankle padding structure 75 may be formed using various shapes. Furthermore, because the outer side of the foot is not normally used in kicking maneuvers, it may not be necessary to provide padding for the lateral malleolus portion of the wearer's ankle, as shown in the illustrated embodiments In the various arrangements, the padding material 68 can have any suitable thickness, and may have a thickness of between 0.25 and 0.5 inches, such as 0.375 inch padding. In some arrangements, the padding material 68 may have a closed-cell foam padding core of 0.375 inch thickness covered by an open-cell foam padding of 0.125 inch thickness. The open cell foam padding is softer for increased comfort, but the closed-cell foam padding offers more injury protection. Areas of the shoe upper 62 which are not thickly padded, such as the sides of the shoe upper 62 may be padded with any suitable thickness of padding, such as 0.125 inch, or may be replaced by an open mesh 69 to allow for added ventilation of the foot of the wearer.

Figure 4:
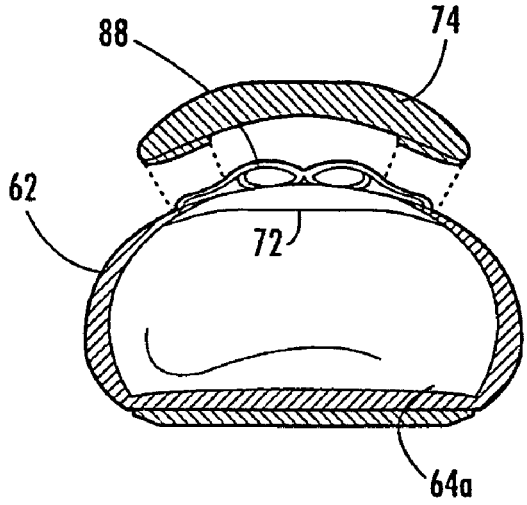
FIG. 4 is a cross-sectional view of the padded shoe in FIG. 1 taken along line 4-4.

In the various arrangements, the shoe 60 can also include a padded tongue 72 and an outer protective flap 74. Both the padded tongue 72 and outer protective flap 74 can include padding material 68. As shown in FIG. 4, both the padded tongue 72 and the outer protective flap 74 can have padding material 68. In some arrangements, the padded tongue 72 can have a greater amount of padding material 68 than the outer protective flap 74. In other arrangements, the outer protective flap 74 may have only a minimal thickness of foam padding, such as 0.125 inch. In other arrangements, the padded tongue 72 could be padded with closed-cell foam, and the outer protective flap could be padded with either closed-cell or open-cell foam. In other arrangements, either the padded tongue 72 or the outer protective flap 74, or both, can extend above the upper edges 66 of shoe upper 62. Extending the padded tongue 72 or the outer protective flap 74 above the shoe upper 62 can advantageously provide protective padding for the lower leg of the wearer.

In some embodiments, the padded tongue 72 may comprise of one or more segments separated by a flexible joint (not shown). In some arrangements, a flexible joint may be naturally formed when the padding material 68 in the padded tongue 72 comprises two separate padding regions. In other arrangements, a stitched seam through the padding may be used to define the flexible joint 22, which can act as a hinge without the need to provide two separate padding regions. The present disclosure contemplates other structures and techniques being used to provide a hinge along flexible joint including decreasing the thickness of continuous padding material 68 along the flexible joint region. The amount of the decreased thickness of the padding material 68 along the region of flexible joint can be chosen based upon various factors, including the amount of mobility that the flexible joint is to allow. The use of such a joint may be advantageous to provide a more secure and comfortable fit, especially in embodiments where the padded tongue 72 is extended to cover at least a portion of the lower leg.

Figure 2:
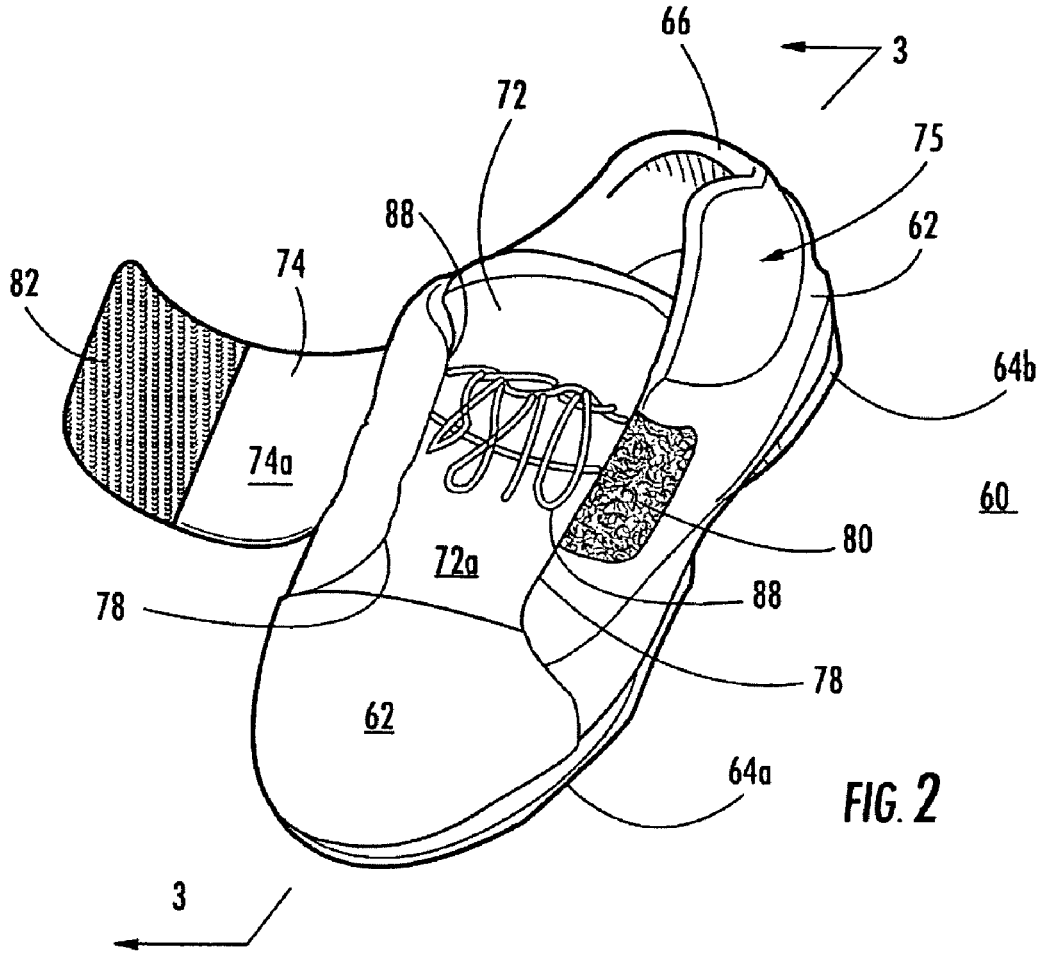
FIG. 2 is a right perspective view of the padded shoe of FIG. 1 with the outer protective flap shown in an outwardly extended position.
Figure 3:
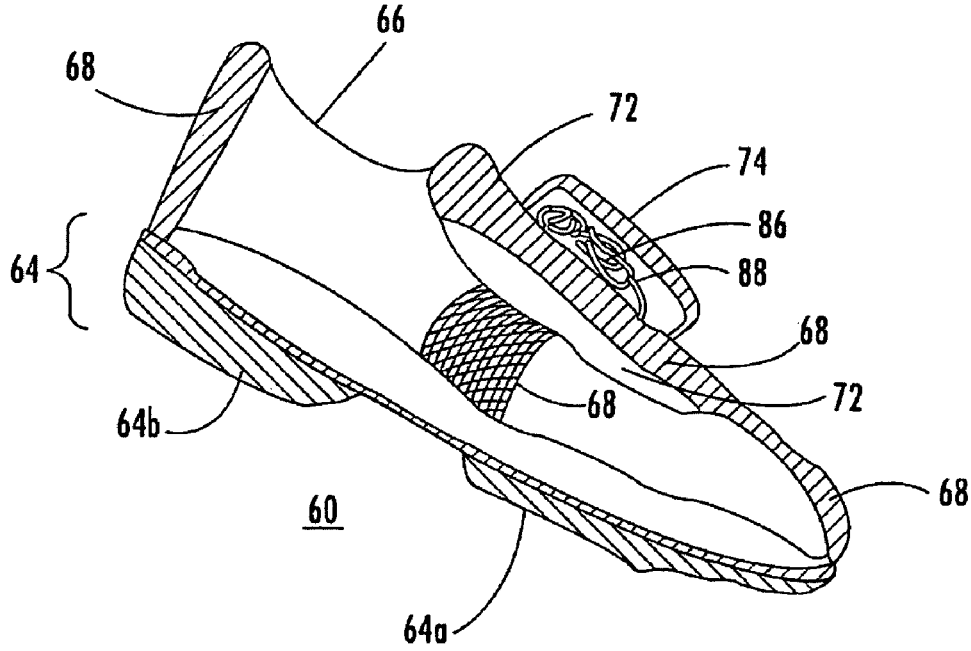
FIG. 3 is a cross-sectional view of the padded shoe of FIG. 2 taken along line 3-3.

FIG. 2 illustrates the outer protective flap 74 in an outwardly extended position. It can be seen that the padded tongue 72 is attached to the shoe upper 62 and can extend over substantially past the top of the foot to the ankle of a wearer. The shoe upper 62 includes oppositely disposed free edges 78 to a vamp throat in the upper 62. The free edges 78 are positioned between the padded tongue 72 and the outer protective flap 74, and extend over the padded tongue 72. The outer protective flap 74 extends widthwise across the shoe. The outer protective flap 74 can be attached to the shoe upper 62 at the medial side of the shoe. That is, on the left shoe, the outer protective flap 74 can be attached to the shoe upper 62 at the right side of the shoe, and on the right shoe, the outer protective flap 74 can be attached to the shoe upper 62 at the left side of the shoe 60.

Figure 5A:
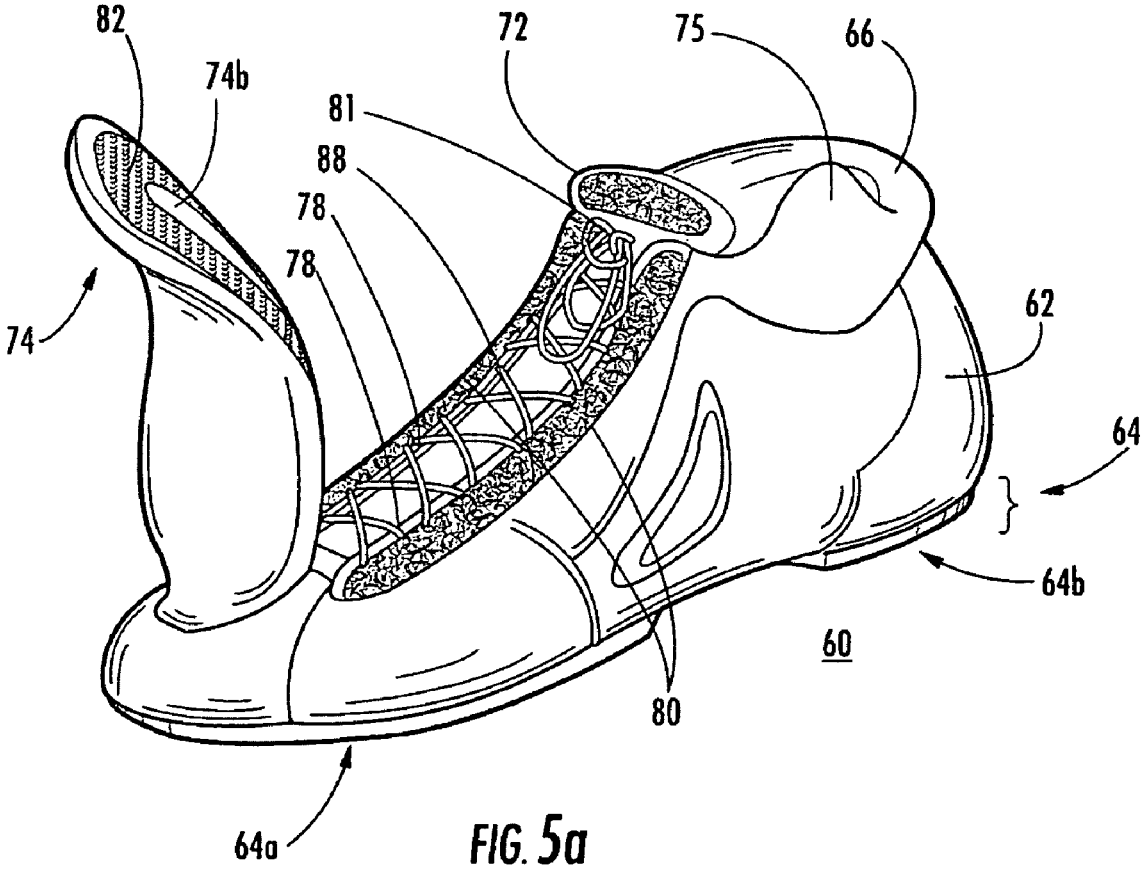
FIG. 5*a* is a perspective view of a padded shoe according to an arrangement of the invention having a lengthwise outer protective flap shown in an outwardly extended position.
Figure 5B:
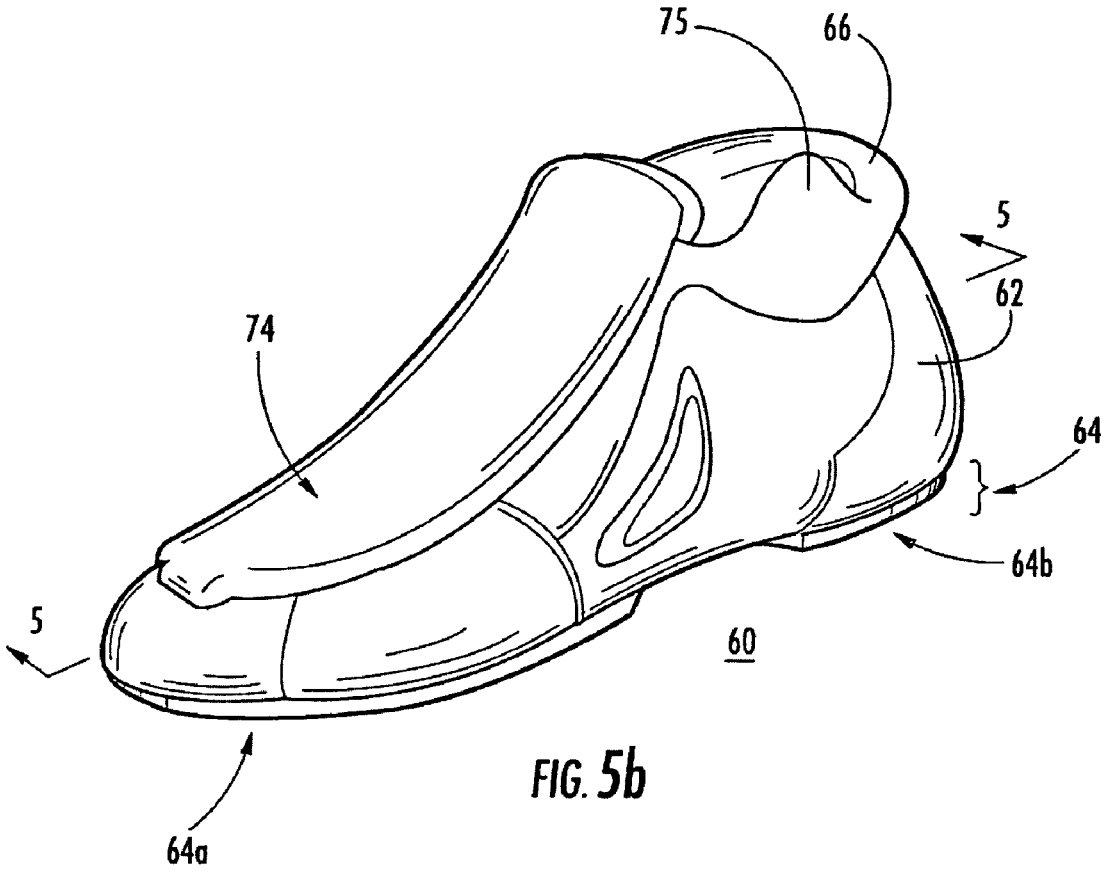
FIG. 5*b* is a perspective view of a padded shoe according to an arrangement of the invention having a lengthwise outer protective flap.
Figure 5C:
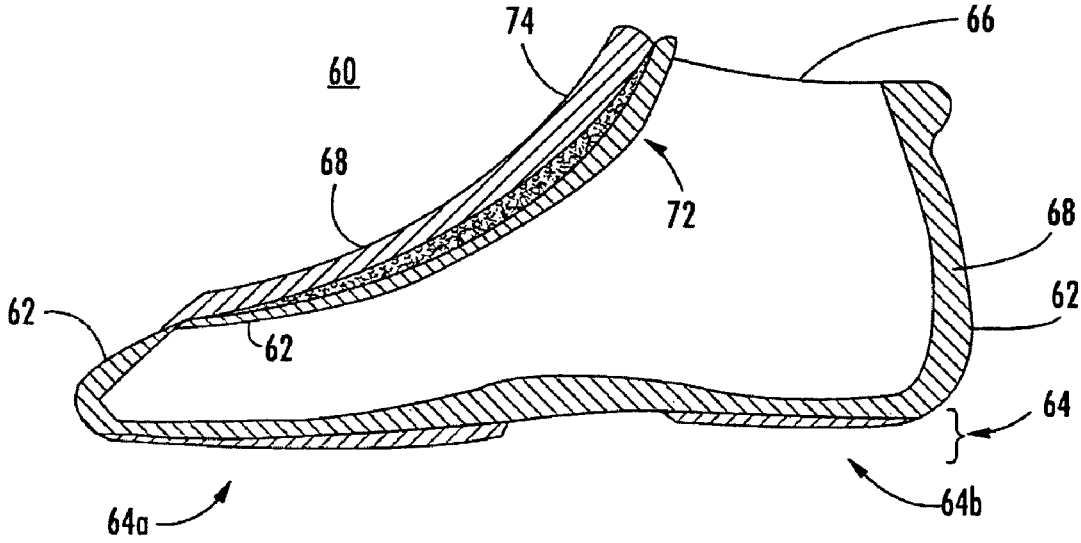
FIG. 5*c* is a cross-sectional view of the padded shoe in FIG. 1 taken along line 5-5.

In other arrangements, as shown in FIGS. 5*a*-5*c*, the outer protective flap 74 extends lengthwise across the shoe 60. In such arrangements, the outer protective flap 74 can be attached to the shoe upper 62 at the bottom of the vamp throat of the shoe 60. Other features of the shoe 60 are similar to the embodiment shown in FIG. 1-4 and will not be further described.

The shoe 60 can also includes an engagement structure to secure the outer protective flap 74 to the shoe upper 62. The engagement structure can be formed of synthetic material portions 80 and 82 which adhere when pressed together, for example, the engagement structure may be formed by a hook and loop type fastener such as Velcro®. As shown in the illustrated arrangement in FIG. 2, the material portions can be affixed to the back surface 74*b* of outer protective flap 74 and at least one of an area proximate to one of the opposing edges 78 of the shoe upper 62. The fastening material portion 80 is attached to the shoe upper 62 proximate to one of the opposing edges 78 so as to be in general alignment with fastening material portion 82 when the outer protective flap 74 is pulled widthwise across the shoe. The fastening material portions 80 and 82 can be attached by any suitable method, such as stitching or adhesives, and can be arranged in any suitable configuration. Any suitable method, or combination of methods, can be used to secure the outer protective flap 74 to prevent movement of the outer protective flap 74 relative to the shoe upper 62 while the shoe 60 is being worn by the wearer.

Alternatively, snaps formed from any suitable material can be utilized to secure the outer protective flap 74, either alone or in combination with hook and loop fastening material described above. Any suitable method, or combination of methods, can be used to secure the outer protective flap 74 to prevent movement of the outer protective flap 74 relative to the shoe upper 62 while the shoe 60 is being worn by the wearer.

Generally, if the tongue of an athletic shoe slips to one side, the shoe can be uncomfortable for the wearer. In some embodiments, the shoe 60 can include an engagement structure to secure the outer protective flap 74 to the padded tongue 72. Any suitable method, or combination of methods, as described for the engagement structure of the outer protective flap 74 to the shoe upper 62, can be used to secure the outer protective flap 74 to the padded tongue 72 to prevent movement of the padded tongue 72 relative to the shoe upper 62 while the shoe 60 is being worn by the wearer. Such an arrangement also provides the advantage of maintaining the padded tongue 72 in an optimum center position, if desired.

Any suitable fastening structure can be utilized that will secure the shoe 60 to the foot of the wearer. The shoe 60 may include a fastening structure that can be selectively tightenable to maintain the shoe on the wearer's foot. The fastening structure can interconnect the free edges 78 to secure the shoe 60 to the foot of the wearer. The fastening structure can be positioned between the inner and outer portions 72 and 74 of tongue 70. The fastening structure can include conventional laces 84 having at least one eyelet or loop 86 located on each of the oppositely disposed edge portions 78 of the shoe upper 62. A lace 88 can be inserted through the loops 86. In some arrangements, hook and loop fasteners can be used in place of the conventional laces 88. Alternatively, the shoe may be held in position on a foot of a wearer by the outer protective flap 74 alone.

Figure 6:
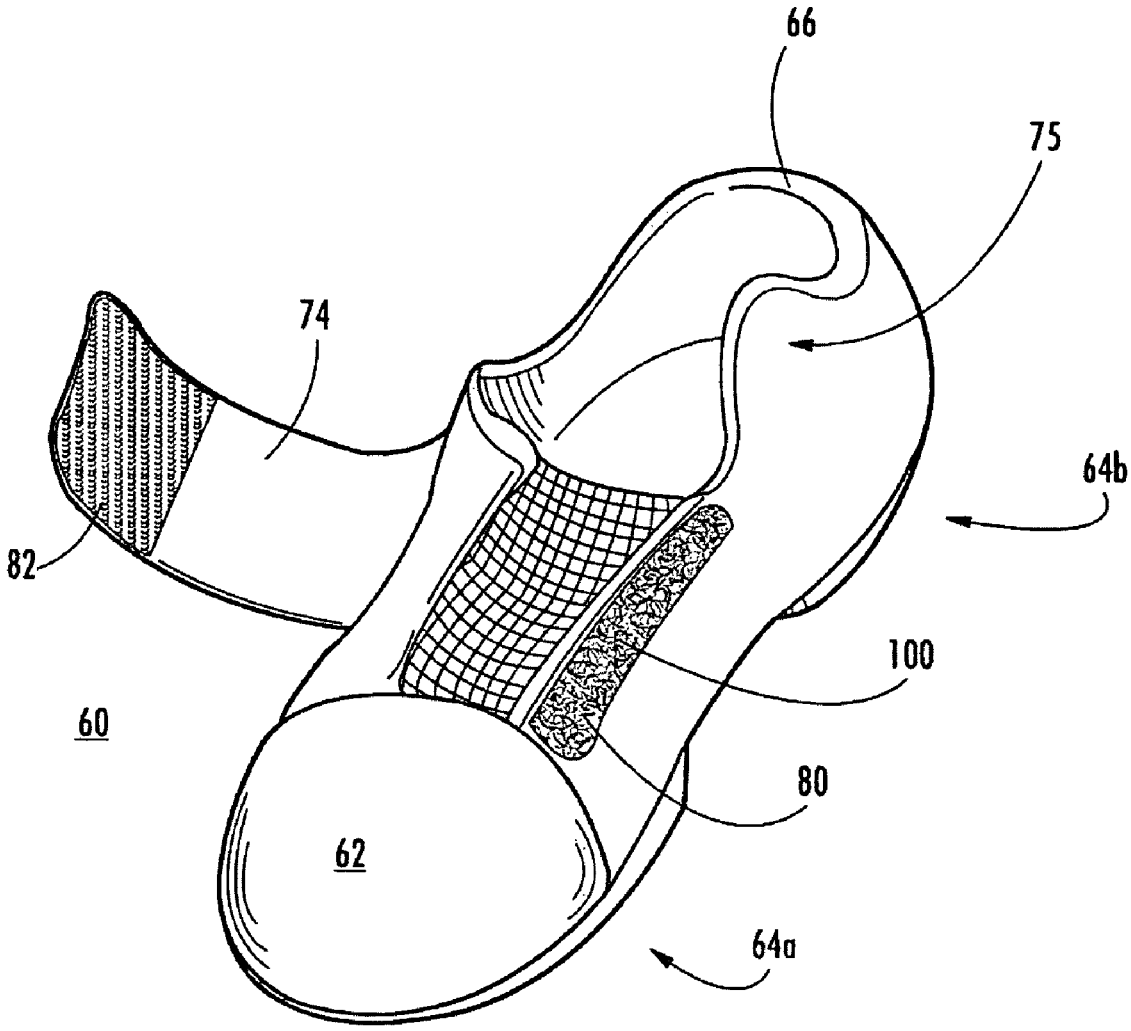
FIG. 6 is a perspective view of a padded shoe according to a further arrangement of the invention.

In another arrangement of the invention, as illustrated in FIG. 6, an elastic strap 100 extends between the free edges 78 to form the retaining structure which retains the shoe on the foot of the wearer. The elastic strap 100 may be disposed between the padded tongue 72 and the outer padded tongue portion 74. In this arrangement, the padding in the outer protective flap 74 can be thinner than in the other arrangements, in order to provide sufficient injury protection to the foot of the wearer, because a user is less likely to suffer injury from an elastic strap or similar retaining structure than from laces. In other arrangements, the outer protective flap need not cover the entire elastic strap 100 and may be located to extend across the top of the free edges 78 only. In such arrangements, an unpadded outer protective flap can be used, because a user is less likely to suffer injury from an elastic strap or similar retaining structure than from laces. In other embodiments of the invention, the retaining structure can also comprise multiple elastic straps. Other features of the shoe are similar to the arrangement shown in FIGS. 1-4, such as the ankle padding structure 75, and will not be further described.

Figure 7:
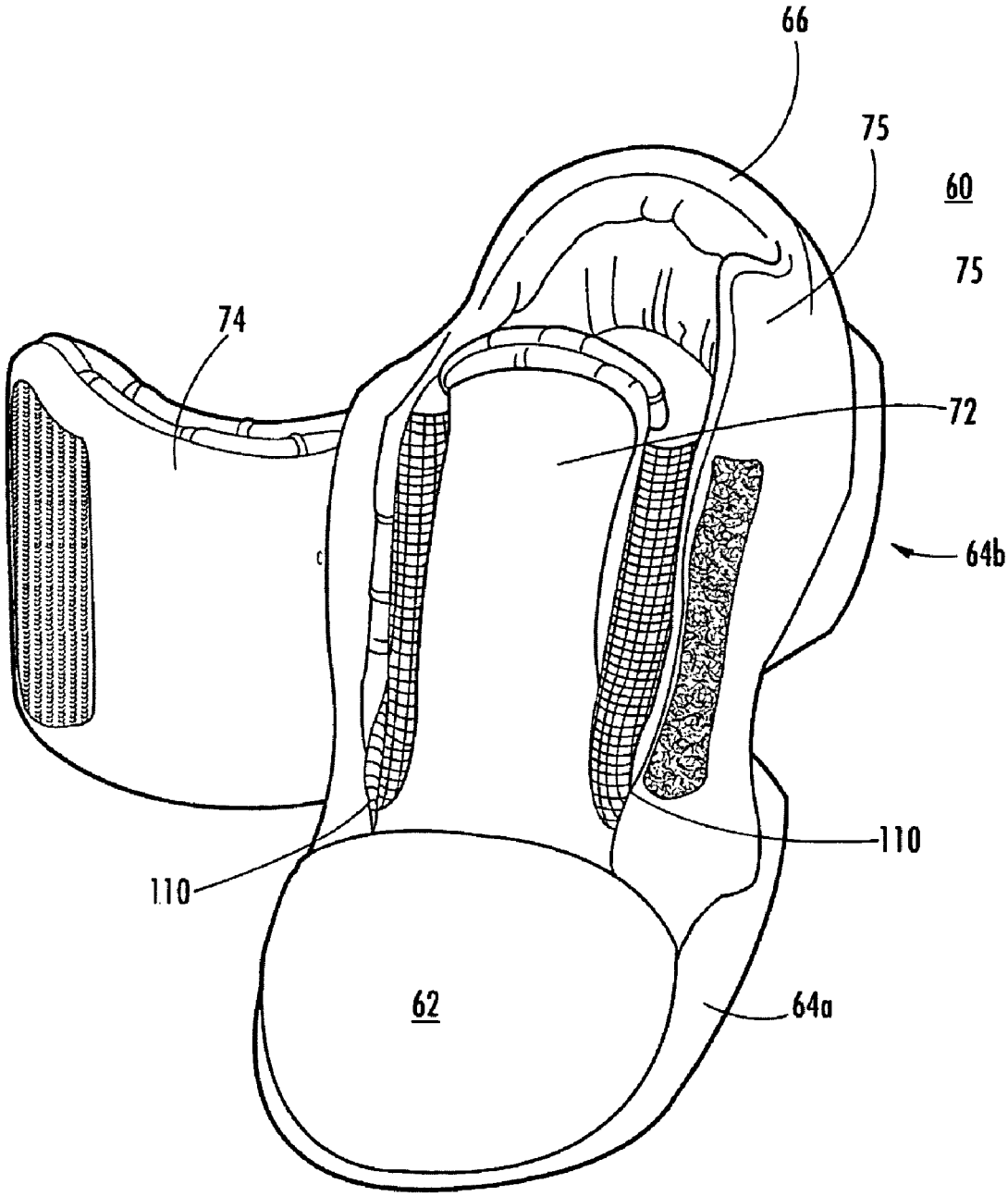
FIG. 7 is a perspective view of a padded shoe according to a further arrangement of the invention.

In a further arrangement of the invention, shown in FIG. 7, two elastic straps 110 extend from edges of the padded tongue 72 to the shoe upper 62. In this arrangement, the padding in the outer protective flap 74 can be thinner than in the other arrangements, in order to provide sufficient injury protection to the foot of the wearer, because a user is less likely to suffer injury from an elastic strap or similar retaining structure than from laces. The padding in the outer protective flap 74 may be thicker over the elastic straps 110. Other features of the shoe are similar to the arrangement shown in FIGS. 6-9, such as the ankle padding structure 75, and will not be further described.

In the various arrangements described, the shoe 60 shown provides advantages to the wearer when the wearer is engaged in activities which involve kicking, as the shoe 60 can have a limited number of protruding exterior features or sharp edges that could possibly injure an opponent. The padded tongue portion 72 provides protection to the top of the wearer's foot when this area is impacted, such as by kicking a bag or an opponent. The outer padded tongue portion 74 advantageously protects an opponent from impact with fastening structure, such as a knotted lace 81. The ankle padding structure 75 advantageous protects both the opponent and the wearer. The wearer's ankle is protected from harm caused by impacts during normal kicks and the opponent is protected from harm caused by the bone of the wearer's ankle, particularly the medial malleolus.

Figure 8:
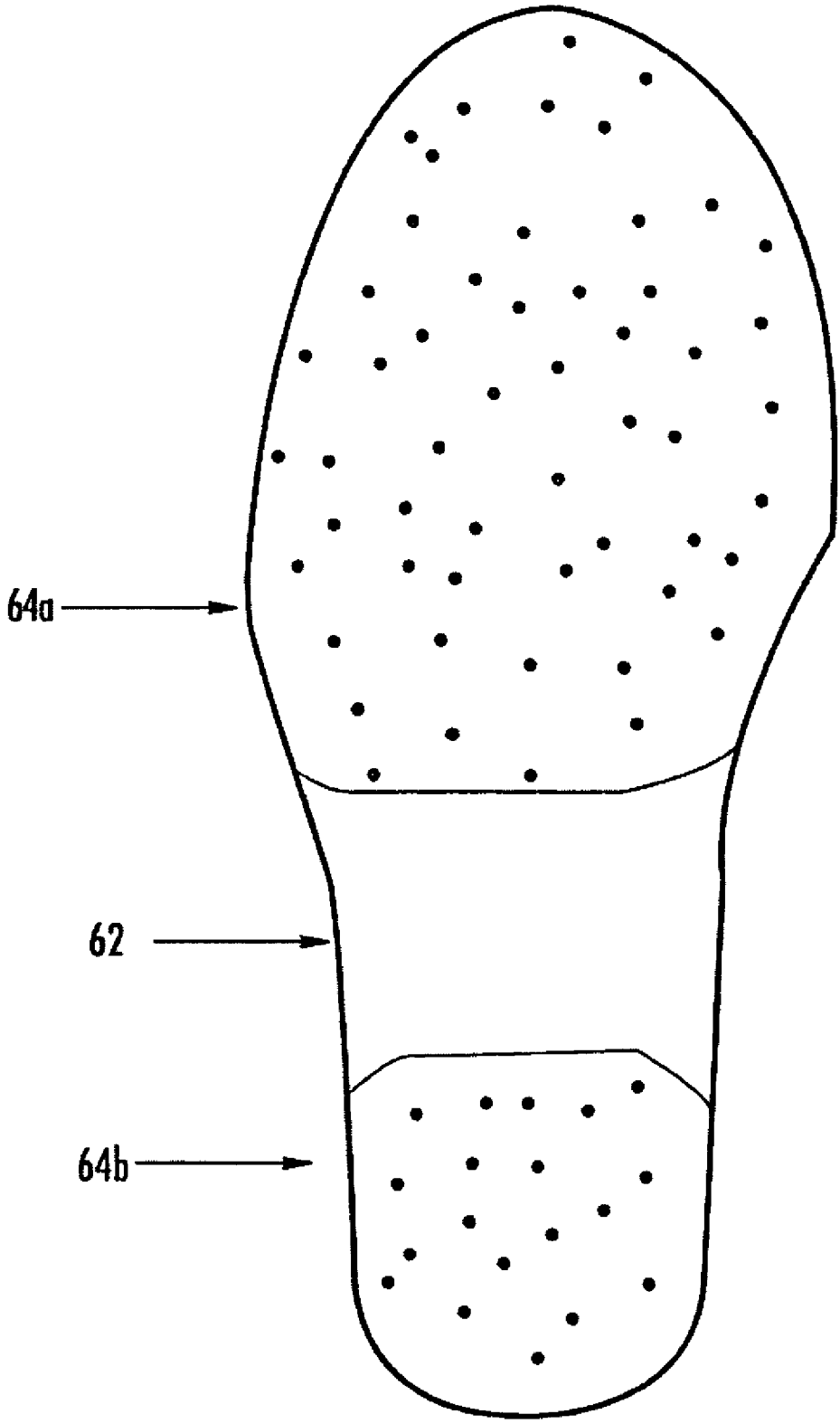
FIG. 8 is a bottom plan view of a padded shoe in accordance with an arrangement of the invention.

In the various arrangements, the lower surface of sole 64 can have any suitable texture. The arrangement in FIG. 8 illustrates the lower surface of forefoot and the rearfoot soles 64*a*, 64*b* having a smooth texture. In the various embodiments, the sole 64 may be generally smooth with substantially no protrusions such as cleats, ridges, or indentations. The smooth texture allows the wearer to pivot on the balls of the feet on a flat surface, such as a gym floor, as would be done when practicing various martial arts sports. In sports such as kickboxing or karate, the bottom of the feet will strike the selected target, typically a kicking bag or a human opponent. In the various arrangements, the smooth texture of the sole 64 can be suitable for contact with both a floor surface and a human opponent or partner.

In some arrangements, the lower surface of the forefoot and rearfoot soles 64*a*, 64*b* may be formed at least partly of crepe rubber. Advantageously, a crepe rubber sole is soft enough to reduce the likelihood of scraping or otherwise injuring a human opponent or partner who comes into contact with the sole, yet durable enough to allow the shoe to be worn on the street, as opposed to primarily on a gym floor. Alternatively, the sole 64 may be formed of EVA.

It will be appreciated that in some arrangements, some slight variation in the surface of the sole such as surface patterning or even small ridges, bumps and/or roughening may be provided on the lower surface of the forefoot and rearfoot soles 64*a*, 64*b*. Such arrangements may provide certain advantages, such as preventing a wearer from slipping on a gym floor while providing a surfaces of the forefoot sole 64*a* and the rearfoot sole 64*b* that are smooth enough to prevent injuries, and particularly facial injuries, to an opponent receiving a kick from a person wearing the shoe. The smooth sole allows the wearer to pivot on the balls of the feet on a flat surface, such as a gym floor, as would be done when practicing various martial arts. In sports such as kickboxing or karate, the bottom of the feet will strike the selected target, typically a kicking bag or a human opponent. It can be appreciated that the smooth texture of the forefoot sole 64*a* and the rearfoot sole 64*b* are suitable for contact with both a floor surface and a human opponent or partner without causing serious injury to the human opponent.

Figure 9:
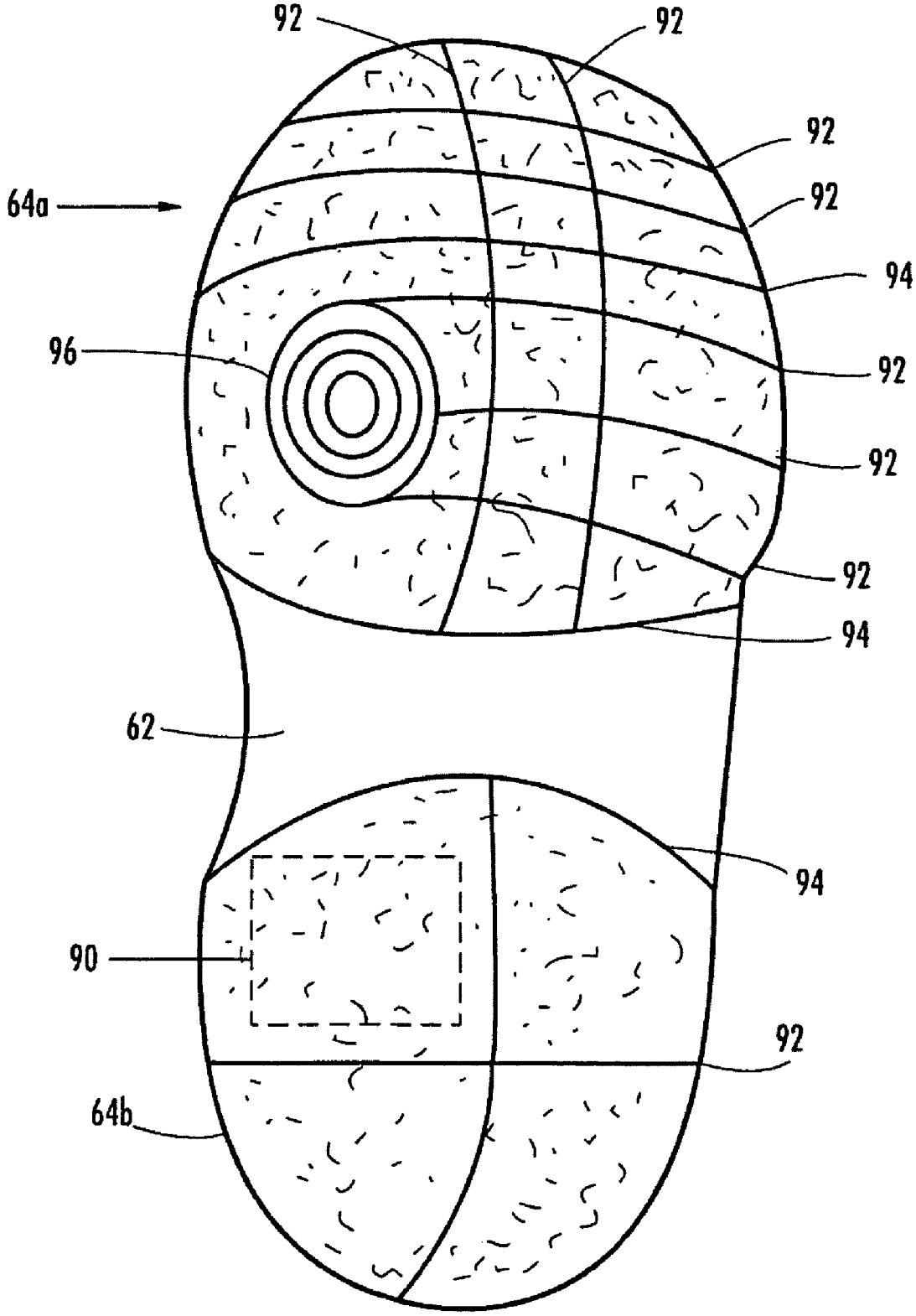
FIG. 9 is a bottom plan view of the padded shoe in accordance with an arrangement of the invention.

FIG. 9 illustrates another possible arrangement of the textures of the lower surfaces of the forefoot sole 64*a* and the rearfoot sole 64*b*, although the invention is not limited to the textures described or shown. The forefoot sole 64*a* and the rearfoot sole 64*b* may have a surface pattern 90 that may be shallowly indented into the surface of the forefoot sole 64*a* and the rearfoot sole 64*b* to prevent the shoe 60 from slipping on the floor of a gym or the like. In addition, the forefoot sole 64*a* and the rearfoot sole 64*b* may have grooves 92 that can contain gripping areas or extrusions 94. The gripping extrusions 94 may be formed of a softer material than the rest of the forefoot sole 64*a* and the rearfoot sole 64*b*. A pivot point 96 of the same material as the gripping extrusions 94 may also be provided. Alternatively, the gripping areas 94 and the pivot point 96 may be created by indentations in the forefoot sole 64*a* and the rearfoot sole 64*b*. The forefoot sole 64*a* and the rearfoot sole 64*b* may be formed of EVA. In an illustrated arrangement, the forefoot sole 64*a* and the rearfoot sole 64*b* may be flexible, and may have a durometer of 0.2 to 0.23. In another embodiment, the forefoot sole 64*a* and the rearfoot sole 64*b* may be flexible, and may have a shore durometer reading of between about 60 and about 40 and more particularly between about 40 and 50.

In some arrangements, the grooves 92 need not contain gripping areas or extrusions. In these arrangements, the grooves 92 may be located in particular locations of the forefoot sole 64*a* and the rearfoot sole 64*b*, to substantially match the natural flex lines of a wearer's foot. In such arrangements, the grooves 92 then allow the shoe 60, when worn, to more closely approximate the natural range of motion of the wearer's foot, arch, and toes.

Figure 10:
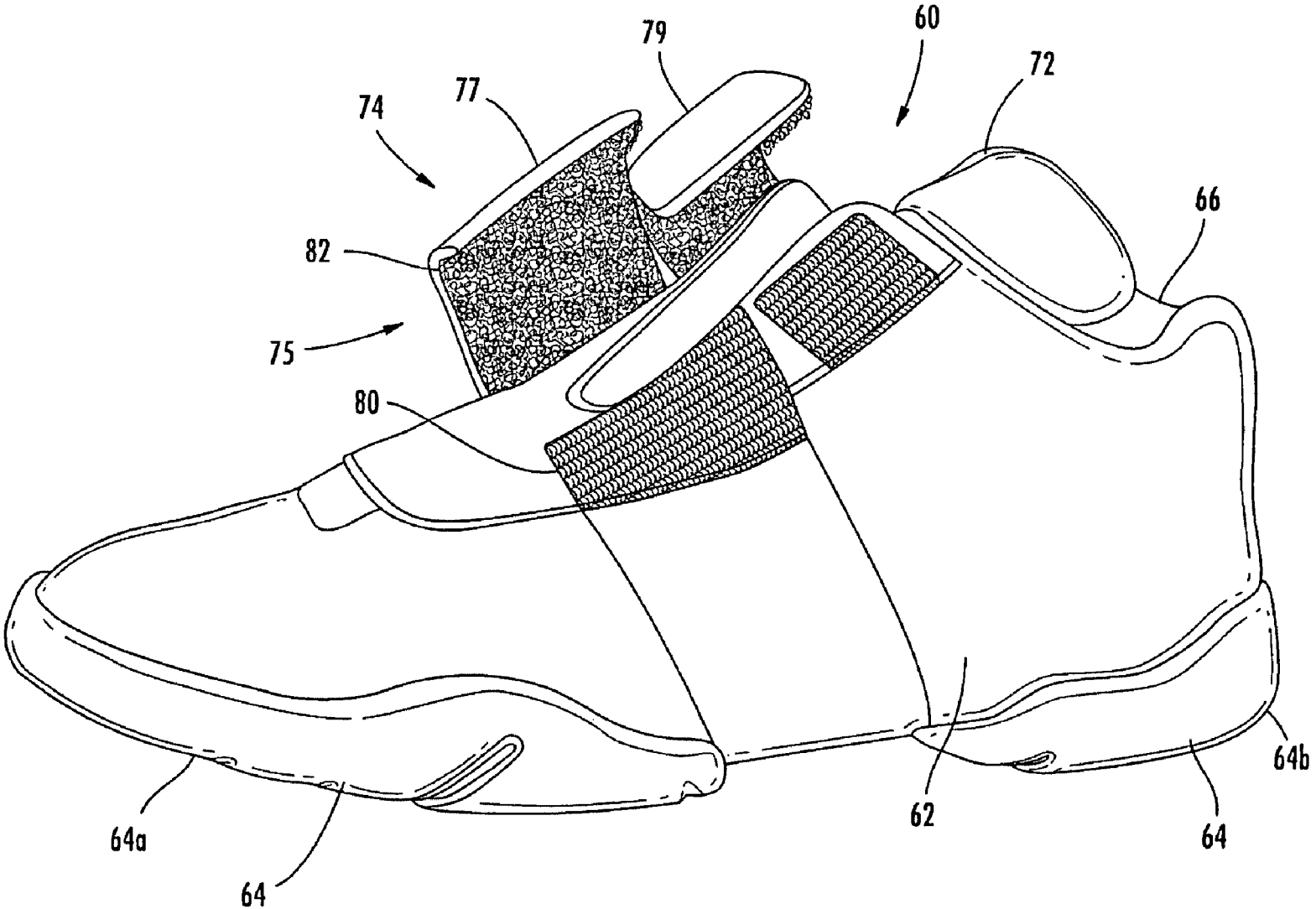
FIG. 10 is a perspective view of an alternative embodiment of the padded shoe.

As shown in FIG. 10, the padded shoe 60 may be formed from materials that are lightweight yet strong and durable. This embodiment of the padded shoe 60 includes the components previously described. For instance, the shoe 60 may include, but is not limited to, a sole 64 adjoined to a shoe upper 62. In the illustrated arrangement, the sole 64 may be formed from a split sole including a forefoot sole 64*a* and rearfoot sole 64*b*. The shoe upper 62 can be manufactured from any conventional material such as leather, synthetic leather, or plastic. In some arrangements, an upper edge 66 of the shoe upper 62 can form a collar into which a foot can be inserted. The padded shoe 60 may include an outer protective flap 74 that is formed from dual protective flaps 74. The dual protective flaps 74 may be similarly configured. As shown in FIG. 10, the lower flap 77 may be wider than the upper flap 79. The flaps 74 may be affixed to the padded shoe 60 on one side and releasably attachable to the padded shoe 60 on the other side with the engagement structure 75. The engagement structure 75 can be formed form material portions 80 and 82, that may be, but are not limited to, hook and loop fasteners. The forefoot sole 64*a* and the rearfoot sole 64*b* may be flexible, and may have a shore durometer reading of between about 40 and about 60 and more particularly between about 40 and 50.

As previously indicated, the shoe 60 provides advantages to the wearer when the wearer is engaged in activities which involve kicking, as the shoe 10 can have a limited number of protruding exterior features or sharp edges that could possibly injure an opponent. The padded tongue 72 provides protection to the top of the wearer's foot when this area is impacted, such as by kicking a bag or an opponent. The outer protective flap 74 advantageously protects an opponent from impact with fastening structure, such as the knotted laces 81. The padding material 68 in the padded tongue 72 further protects the top of the wearer's foot on impact from the lacing 88 and knots in the lacing 81.

It should be understood that the examples and arrangements described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A padded shoe, comprising:

a flexible, resilient sole having a substantially smooth surface, wherein the sole is formed from a material having a shore durometer reading between about 40 and about 60;

a shoe upper adjoined to the sole, wherein at least a portion of the shoe upper has padding disposed therein, the shoe upper defining a vamp having a throat and a quarter having an ankle collar top line;

an ankle padding structure extending from the shoe upper, the ankle padding structure being adapted such that the ankle padding structure at least partially covers the medial malleolus of a wearer and does not cover the lateral malleolus;

a padded tongue attached to the shoe upper;

an outer protective flap attached to the shoe upper, the outer protective flap being located such that the outer protective flap covers at least a portion of the padded tongue; and an engagement structure for securing the outer protective flap to the shoe upper, the engagement structure being located at least partially under the outer protective flap such that the outer protective flap substantially covers the engagement structure, wherein the wearer can strike a target with the shoe, and the target and the wearer are protected from injury caused by direct impact with at least one of the engagement structure and the wearer's medial malleolus.

2. The padded shoe of claim 1, where the sole is formed from a material having a shore durometer reading between about 40 and about 50.

3. The padded shoe of claim 1, the flexible sole further comprising a split sole, wherein the split sole comprises a separate forefoot sole portion under the front portion of the shoe upper and a separate rearfoot sole portion under the heel portion of the shoe upper.

4. The padded shoe of claim 1, wherein the outer protective flap has closed-cell foam padding disposed therein.

5. The padded shoe of claim 1, wherein the outer protective flap is attached to the shoe upper at one side of the outer protective flap.

6. The padded shoe of claim 5, wherein the outer protective flap is formed from dual outer protective flaps.

7. The padded shoe of claim 1, wherein the padded tongue portion has closed-cell foam padding disposed therein.

8. The padded shoe of claim 1, wherein the retaining structure comprises elastic material disposed between the padded tongue portion and the sole.

9. The padded shoe of claim 1, wherein the padding in the shoe upper is closed-cell foam having a durometer of approximately 0.253.

10. The padded shoe of claim 1, wherein the padding in the shoe upper is closed cell foam having a density of between approximately 1.5 pcf and approximately 4.5 pcf.

11. The padded shoe of claim 1, wherein the padding in the shoe upper is closed-cell foam having a compression strength of between approximately 3 psi and approximately 23 psi at approximately 25% deflection and a compression strength of between approximately 9 psi and approximately 42 psi at approximately 50% deflection.

12. The padded shoe of claim 1, wherein the padding in the shoe upper has a thickness between approximately 0.125 inch and approximately 3.0 inch.

13. The padded shoe of claim 1, wherein at least a portion of the sole has a surface pattern having a plurality of grooves disposed on a lower surface of the sole, whereby the plurality of grooves operate to increase flexibility of the sole and are arranged to allow a flexing of the sole to generally match a natural flexing of a wearer's foot.

14. The padded shoe of claim 1, wherein at least a portion of the perimeter of the sole is chamfered.

15. The padded shoe of claim 1, wherein the sole is formed at least partially from EVA.

16. The padded shoe of claim 1, wherein the engagement structure comprises hook and loop fastener material.

17. A padded shoe, comprising:

a flexible, resilient sole having a substantially smooth surface, wherein the sole is formed from a material having a shore durometer reading between about 40 and about 60;

wherein the sole is a split sole comprising a separate forefoot sole portion under the front portion of the shoe upper and a separate rearfoot sole portion under the heel portion of the shoe upper;

a shoe upper adjoined to the sole, wherein at least a portion of the shoe upper has padding disposed therein, the shoe upper defining a vamp having a throat and a quarter having an ankle collar top line;

an ankle padding structure extending from the shoe upper, the ankle padding structure being adapted such that the ankle padding structure at least partially covers the medial malleolus of a wearer and does not cover the lateral malleolus;

a padded tongue attached to the shoe upper;

a dual outer protective flap attached to the shoe upper, the dual outer protective flap being located such that the outer protective flap covers at least a portion of the padded tongue; and an engagement structure for securing the dual outer protective flap to the shoe upper, the engagement structure being located at least partially under the outer protective flap such that the dual outer protective flap substantially covers the engagement structure, wherein the wearer can strike a target with the shoe, and the target and the wearer are protected from injury caused by direct impact with at least one of the engagement structure and the wearer's medial malleolus.

18. The padded shoe of claim 17, where the sole is formed from a material having a shore durometer reading between about 40 and about 50.

19. The padded shoe of claim 17, wherein the padding in the shoe upper is closed-cell foam having a shore durometer of approximately 0.253.

20. The padded shoe of claim 17, wherein the padding in the shoe upper is closed cell foam having a density of between approximately 1.5 pcf and approximately 4.5 pcf and having a compression strength of between approximately 3 psi and approximately 23 psi at approximately 25% deflection and a compression strength of between approximately 9 psi and approximately 42 psi at approximately 50% deflection.

* * * * *